US008915549B2

(12) United States Patent
Addiego

(10) Patent No.: US 8,915,549 B2
(45) Date of Patent: Dec. 23, 2014

(54) LIFTING APPARATUS

(76) Inventor: Raphael Addiego, East Lansing, MI (US)

( * ) Notice: Subject to any disclaimer, the term of this patent is extended or adjusted under 35 U.S.C. 154(b) by 508 days.

(21) Appl. No.: 13/180,042

(22) Filed: Jul. 11, 2011

(65) Prior Publication Data

US 2012/0025572 A1 Feb. 2, 2012

Related U.S. Application Data

(60) Provisional application No. 61/363,423, filed on Jul. 12, 2010.

(51) Int. Cl.

| | |
|---|---|
| ***A47C 15/00*** | (2006.01) |
| ***A61G 5/00*** | (2006.01) |
| ***A61G 5/14*** | (2006.01) |
| *A61G 7/10* | (2006.01) |

(52) U.S. Cl.

CPC ..... *A61G 5/14* (2013.01); *A61G 7/1015* (2013.01)

USPC ..... 297/463.2; 5/81.1 R

(58) Field of Classification Search

USPC ..... 297/DIG. 10, 463.2; 5/85.1, 87.1, 88.1, 5/89.1, 81.1 R, 83.1

See application file for complete search history.

(56) References Cited

U.S. PATENT DOCUMENTS

| | | | | |
|---|---|---|---|---|
| 659,755 A | | 10/1900 | Moulton | |
| 941,620 A | * | 11/1909 | Comer | 5/83.1 |
| 1,059,815 A | * | 4/1913 | Belles | 5/87.1 |
| 1,078,090 A | | 11/1913 | Foss | |
| 1,082,177 A | | 12/1913 | Skeffington | |
| 1,197,472 A | | 9/1916 | Foy | |
| 1,649,013 A | | 11/1927 | Bell | |
| 2,100,663 A | | 11/1937 | Maddox | |
| 2,439,066 A | * | 4/1948 | Vanderlyn et al. | 5/88.1 |
| 2,774,079 A | | 12/1956 | Flatley | |
| 3,302,219 A | | 2/1967 | Harris | |
| 3,438,067 A | | 4/1969 | Saunders | |
| 3,886,605 A | | 6/1975 | Harris | |
| 4,507,814 A | | 4/1985 | Zyki, Jr. | |
| 4,821,352 A | | 4/1989 | DiMatteo et al. | |

(Continued)

FOREIGN PATENT DOCUMENTS

JP 2010-240036 A 10/2010

OTHER PUBLICATIONS

EZ Lift, Inc. catalogue form #2-170, revised Dec. 6, 2010.

(Continued)

*Primary Examiner* — Milton Nelson, Jr.

(74) *Attorney, Agent, or Firm* — Mary M. Moyne; Fraser Trebilcock Davis & Dunlap, PC

(57) ABSTRACT

A lifting apparatus for lifting a user from a sitting position to a semi-upright position. The lifting apparatus is positioned under the seat portion and along the back portion of the chair. The lifting surface extends from a first roller over a second roller and along the front surface of the chair to the base of the lifting apparatus adjacent the front of the chair. A seating area can be provided in the lifting surface to keep the user in position on the lifting surface. To use the lifting apparatus, the first roller is rotated to wrap the lifting surface onto the first roller which moves the lifting surface away from the front surface of the chair and lifts the user away from the chair.

30 Claims, 5 Drawing Sheets

(56) References Cited

U.S. PATENT DOCUMENTS

| | | | | |
|---|---|---|---|---|
| 4,843,665 | A | 7/1989 | Cockel et al. | |
| 5,039,165 | A | 8/1991 | Rothman et al. | |
| 5,082,327 | A | 1/1992 | Crisp | |
| 5,084,921 | A | 2/1992 | Hicks, Jr. | |
| 5,127,113 | A | 7/1992 | Di Matteo et al. | |
| 5,333,333 | A | 8/1994 | Mah | |
| 5,524,304 | A | 6/1996 | Shutes | |
| 5,596,775 | A | 1/1997 | DiMatteo et al. | |
| 5,659,905 | A | 8/1997 | Palmer, Jr. et al. | |
| 6,295,666 | B1 | 10/2001 | Takaura | |
| 6,425,634 | B1 | 7/2002 | Romero | |
| 6,619,681 | B2 * | 9/2003 | Gutierrez | 280/250.1 |
| 7,013,511 | B2 | 3/2006 | Maschke | |
| 8,104,115 | B2 * | 1/2012 | Gramkow et al. | 5/83.1 |
| 2005/0273927 | A1 | 12/2005 | Tally | |
| 2008/0189852 | A1 | 8/2008 | Gramkow et al. | |

OTHER PUBLICATIONS www.spinlife.com, Uplift Technologies Risedale Lifting Seat Chair, web page, Mar. 12, 2014.

www.spinlife.com, Uplift Technologies UPEASY Seat Assist Portable Lifting Seat, web page, Mar. 12, 2014.

www.spinlife.com, Uplift Technologies UPEASY Power Seat, web page, Mar. 12, 2014.

* cited by examiner

LIFTING APPARATUS

CROSS REFERENCES TO RELATED APPLICATIONS

This application claims the benefit of U.S. Provisional Application No. 61/363,423, filed Jul. 12, 2010, which is hereby incorporated herein by reference in its entirety, except that the present application supersedes any portion of the above referenced application which is inconsistent with the present application.

STATEMENT REGARDING FEDERALLY SPONSORED RESEARCH OR DEVELOPMENT

Not Applicable

BACKGROUND OF THE INVENTION

Field of the Invention

The present invention relates to a lifting apparatus for assisting a user in exiting a chair. In particular, the present invention relates to a lifting apparatus having a lifting surface which drapes over the front of the chair and which lifts the user to a semi-upright position as the lifting surface is tightened.

The substance and advantages of the present invention will become increasingly apparent by reference to the following drawings and the description.

BRIEF SUMMARY OF THE INVENTION

Figure 1:
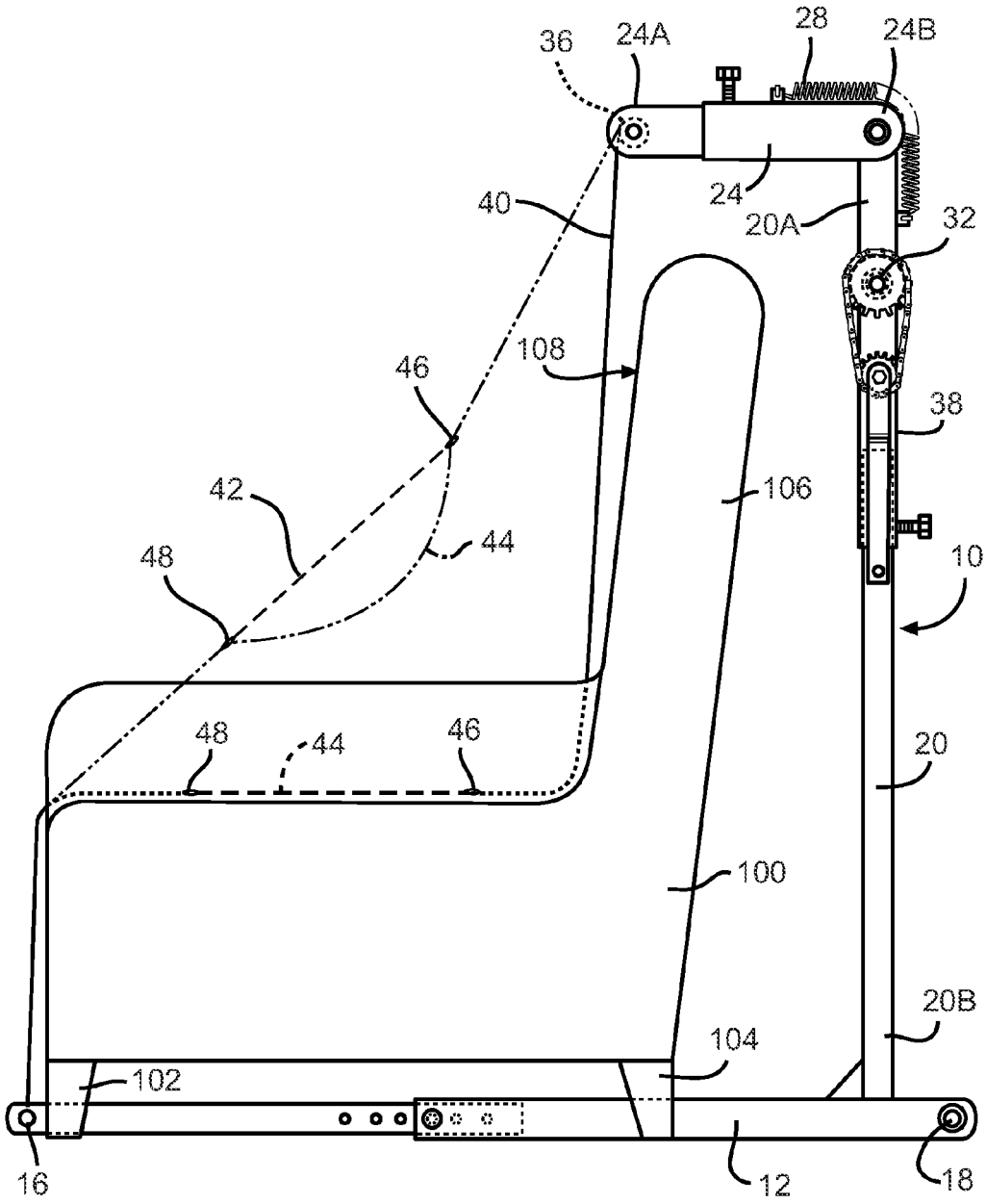
FIG. 1 is a side view of the lifting apparatus 10 in position around a chair 100 showing the base 12, the back frame 20 and the lifting surface 40 with the extension 24 in the pivoted position.
Figure 2:
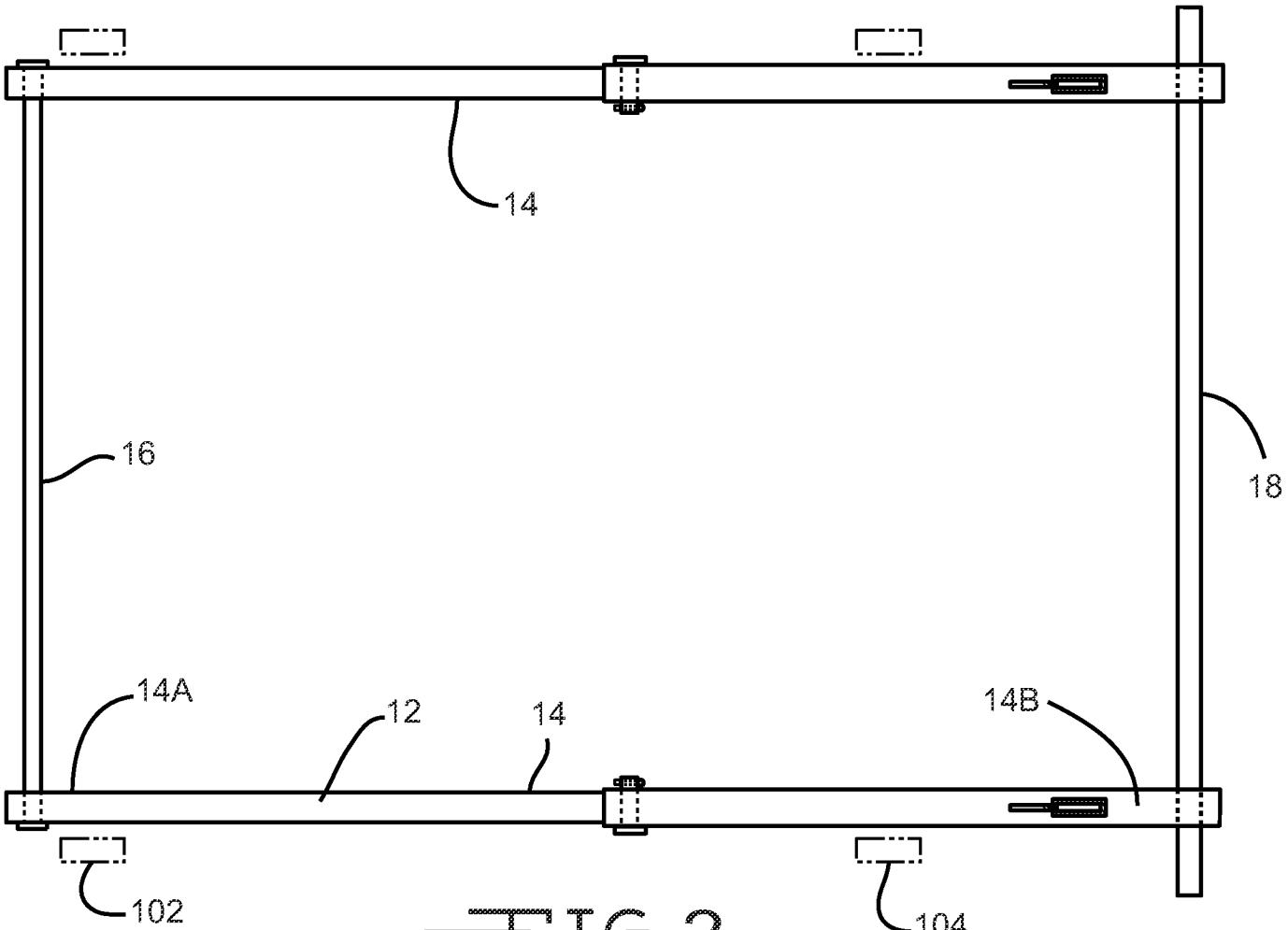
FIG. 2 is a top view of the base 12.

A lifting apparatus which lifts a user from a sitting position in a chair to a semi-upright position to assist the user in exiting the chair. The lifting apparatus is portable and intended to be used with an existing chair or sofa. The lifting apparatus includes a base, a back frame, an extension, rollers, an activation mechanism and a lifting surface. The base is positioned under the seat portion of the chair. In one (1) embodiment, the base extends beyond the front and back legs of the chair. The back frame is connected to the base adjacent the back portion of the chair. The base and back portion of the lifting apparatus can be pivotably connected together to allow for easier storage of the lifting apparatus. The back frame extends upward from the base essentially perpendicular to the base. The extension is pivotably mounted to the end of the back frame opposite the base. The extension can pivot from an at rest unpivoted, upright position essentially aligned with the back frame to a pivoted, essentially horizontal use position essentially perpendicular to the back frame. A tensioner is mounted between the extension and the back frame to pivot the extension to the upright, at rest position when the chair and the lifting apparatus are not is use. In the pivoted, use position, the extension extends over the back portion of the chair. In one (1) embodiment, when the extension is in the pivoted, use position, the first end of the extension, opposite the back frame, extends beyond the back portion of the chair. A first roller is rotatably mounted on the back frame between the ends of the back frame. A second roller is rotatably mounted at the connection point of the back frame and the extension. A third roller is rotatably mounted at the first end of the extension opposite the back frame. A lifting surface extends from the first roller over the second and third roller and along the front surface of the chair to the base adjacent the front of the chair. The lifting surface is constructed of a pliable material so that in use, the lifting surface follows the lines of the chair. A seating area can be provided in the lifting surface to accommodate a user's backside.

To use the lifting apparatus to move a user from a seated position to a semi-upright position, the user sits in the chair which moved the lifting surface into contact with the front surface of the chair and pivots the extension into the horizontal, use position. Next, the activation mechanism is activated to rotate the first roller which rolls the lifting surface onto the first roller which tightens the lifting surface and moves the lifting surface away from the front surface of the chair. As the lifting surface moves away from the chair, the lifting surface lifts the user away from the chair. The position of the third roller essentially above a back of the user and above the head of the user, allows for an essentially directly vertical or upward force to be applied on the lifting surface to lift the user. The rollers assist in reducing the drag on the lifting surface. The seating area helps to keep the user in position on the lifting surface as the lifting surface is moved and lifted and prevents the user from slipping along the lifting surface.

The present invention relates to a lifting apparatus for use with a chair which includes a base, a back frame connected to the base, an extension mounted on the back frame, a first roller rotatably mounted on the back frame, a second roller rotatably mounted on the extension, a lifting surface connected between the first roller and the base, and an activation mechanism connected to the first roller for rotating the first roller to move the lifting surface onto the first roller and away from a front surface of the chair.

Further, the present invention relates to a lifting apparatus for use with a chair which includes a base having a first end and a second end, a back frame having a first end and a second end and mounted on the second end to the second end of the base, an extension having a first end and second end and mounted on the second end to the first end of the back frame, a first roller rotatably mounted between the first and second ends of the back frame, a second roller rotatably mounted adjacent the first end of the back frame, an activation mechanism connected to the first roller for rotating the first roller, and a lifting surface having opposed first and second ends and connected at the first end to the first roller and connected at the second end to the base, wherein the lifting surface is configured to extend adjacent a front surface of the chair.

Still further, the present invention relates to a method of lifting a user from a chair, which includes the steps of providing a lifting apparatus having a base, a back frame connected to the base, an extension mounted on the back frame, a first roller rotatably mounted on the back frame; a second roller rotatably mounted on the extension, a lifting surface having first and second ends and connected between the first roller and the base, and an activation mechanism connected to the first roller, positioning the lifting apparatus so that the base of the lifting apparatus extends adjacent and below a seat of the chair and the back frame extends upward adjacent a back portion of the chair, connecting the first end of the lifting surface to the first roller and the second end of the lifting surface to the base so that the lifting surface extends over the chair adjacent a front surface of the chair, sitting the user in the chair so that the lifting surface is positioned between the user and the front surface of the chair; and activating the activation mechanism so that the first roller rotates and wraps the lifting surface around the first roller and a length of the lifting surface adjacent the front surface of the chair is reduced so that the lifting surface is moved way from the front surface of the chair and so that the user in the chair on the lifting surface is moved away from the front surface of the chair to a semi-upright position.

The substance and advantages of the present invention will become increasingly apparent by reference to the following drawings and the description.

DETAILED DESCRIPTION OF THE INVENTION

Figure 3:
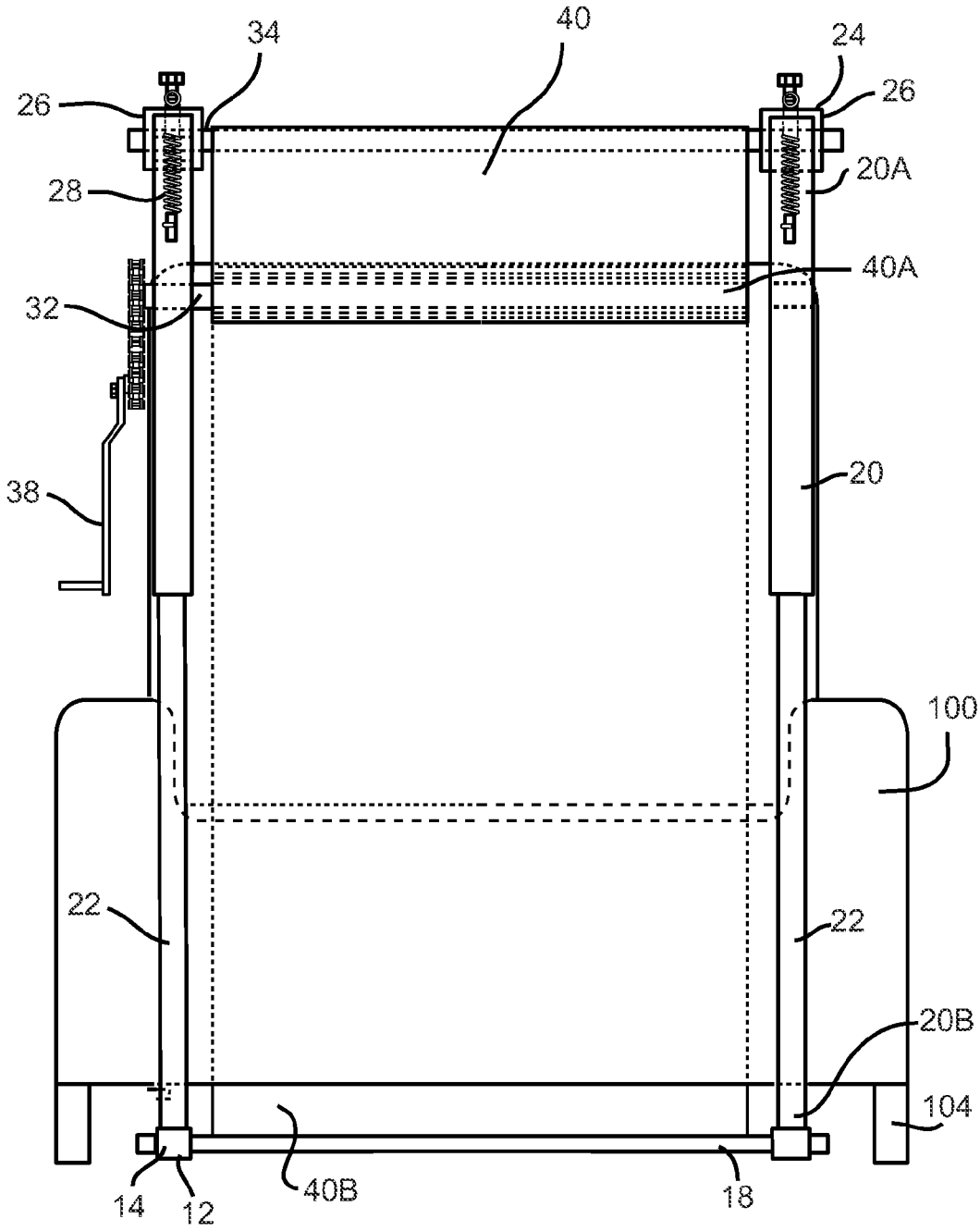
FIG. 3 is a back view of the lifting apparatus 10 in position around a chair 100 showing the main roller 32.

The lifting apparatus 10 of the present invention is for use with a chair 100 to assist a user in exiting the chair 100. The lifting apparatus 10 includes a base 12, a back frame 20 and a lifting surface 40. In one (1) embodiment, the base 12 includes a pair of members or beams 14 having opposed first and second ends 14A and 14B which are connected together at both ends 14A and 14B. A front bar 16 extends between the first ends 14A of the beams 14. In one (1) embodiment, a back bar 18 is provided between the second ends 14B of the beams 14 of the base 12. In one (1) embodiment, the beams 14 have a length between the ends 14A and 14B such that when the beams 14 are positioned underneath the chair 100, the first ends 14A of the beams 14 extend outward beyond the front legs 102 of the chair 100 and the second ends 14B of the beams 14 extend outwards beyond the back legs 104 of the chair 100. In one (1) embodiment, the length of the beams 14 between the ends 14A and 14B is adjustable to accommodate chairs of various sizes. In one (1) embodiment, the beams 14 are connected together in a parallel, spaced apart relationship. In one (1) embodiment, the beams 14 are spaced apart such that the base 12 can slide between the left side and right side legs of the chair 100 such that the base 12 does not extend beyond the sides of the chair 100 (FIG. 3). In one (1) embodiment, the beams 14 are constructed of flat, metal pieces. In one (1) embodiment, the beams 14 are formed by multiple pieces which are telescopingly mounted together to allow for adjusting the length of the beams 14 between the ends 14A and 14B. In one (1) embodiment, the beams 14 have a square cross section. The base 12 can be constructed of any well know durable material. In one (1) embodiment, the base 12 is lightweight. It is understood that the base 12 can have a variety of shapes. In another embodiment, the base 12 has a single bar extending from the front bar 16 to the back frame 20.

The back frame 20 has a first end 20A and a second end 20B. The second end 20B of the back frame 20 is mounted to the second ends 14B of the beams 14 of the base 12. In one (1) embodiment, the second ends 14B of the beams 14 of the base 12 extend backwards beyond the back frame 20 to provide additional stability to the lifting apparatus 10. In one (1) embodiment, the back frame 20 is connected to the base 12 at a point spaced between the back bar 18 and the back legs 104 of the chair 100. In one (1) embodiment, the second end 20B of the back frame 20 is pivotably mounted to the second ends 14B of the beams 14 of the base 12 so that when the lifting apparatus 10 is not in use, the base 12 and back frame 20 can be folded together for easier storage. In one (1) embodiment, the back frame 20 is vertically adjustable between the first end 20A and the second end 20B to accommodate chairs having a variety of sizes. In one (1) embodiment, the back frame 20 includes a pair of side bars 22 which extend upward from the base 12 adjacent the back portion 106 of the chair 100. In one (1) embodiment, the side bars 22 are constructed of multiple pieces which are telescopingly mounted together to enable the height of the back frame 20 to be easily adjusted. In one (1) embodiment, the left side beam 14 of the base 12 is connected to the left side bar 22 of the back frame 20 and the right side beam 14 of the base 12 is connected to the right side bar 22 of the back frame 20. In use, the back frame 20 is substantially perpendicular to the base 12. In one (1) embodiment, a lock is provided between the base 12 and the back frame 20 to lock the back frame 20 in the upright position. In one (1) embodiment, a support bracket is provided at the connection point between the beams 14 and the side bars 22 of the back frame 20.

A tightening mechanism for the lifting surface 40 is mounted adjacent the first end 20A of the back frame 20. In one (1) embodiment, the tightening mechanism includes rollers, an activation mechanism and an extension 24. In one (1) embodiment, the rollers include a first, main roller 32, a second, idle roller 34 and a third, idle roller 36. The main roller 32 is rotatably mounted between the side bars 22 of the back frame 20 spaced apart from the first end 20A of the back frame 20. In one (1) embodiment, the main roller 32 extends between the side bars 22 of the back frame 20 such that the ends of the main roller 32 are journaled in the side bars 22. In one (1) embodiment, the main roller 32 is positioned such as to be essentially level with the top of the back portion 106 of the chair 100. In one (1) embodiment, the main roller 32 and the idle rollers 34 and 36 are similar and are cylindrical shafts.

An extension 24 having a first end 24A and a second end 24B and is pivotably mounted at the second end 24B to the first end 20A of the back frame 20. In one (1) embodiment, the pivot point between the extension 24 and the back frame 20 is provided by a shaft which forms the first idle roller 34 of the tightening mechanism. The extension 24 is pivotably mounted on the first end 20A of the back frame 20 such that the extension 24 can pivot forward toward the chair 100. The extension 24 can pivot such as to be essentially perpendicular to the back frame 20. In another embodiment, the extension 24 does not pivot and is fixably mounted to the first end 20A of the back frame 20 perpendicular to the back frame 20 and essentially horizontal to the seat of the chair 100. In this embodiment, the first end 24A of the extension 24 extends beyond the front surface 108 of the back portion 106 of the chair 100. In one (1) embodiment, the extension 24 has a length between the ends 24A and 24B such that when the extension 24 in the pivoted, essentially horizontal position, the first end 24A of the extension 24 extends over and beyond the back portion 106 of the chair 100. In one (1) embodiment, the length of the extension 24 between the ends 24A and 24B is adjustable. In one (1) embodiment, the extension 24 includes right and left side members 26 which are pivotably connected to the right and left side bars 22 of the back frame 20. The second idle roller 34 is mounted adjacent the second end 24B of the extension 24 and the third idle roller 36 is mounted adjacent the first end 24A of the extension 24. In one (1) embodiment, the third idle roller 36 is a shaft which extends between the side members 26 of the extension 24 with the ends of the shaft journaled in the side members 26. In one (1) embodiment, the ends of the second idle roller 34 are journaled in both side members 26 of the extension 24 and the side bars 22 of the back frame 20. The second and third idle rollers 34 and 36 are able to rotate freely so as to provide minimal drag on the lifting surface 40 as the lifting surface is tightened to lift the user. In one (1) embodiment, the side members 26 of the extension 24 are mounted adjacent the outer surface of the side bars 22 of the back frame 20 so that the side bars 22 of the back frame 20 are sandwiched between the side members 26 and the extension 24.

In one (1) embodiment, a tensioner 28 is provided between the back frame 20 and the extension 24. In one (1) embodiment, the tensioner 28 is a coil spring mounted between each of the side bars 22 of the back frame 20 and each of the side members 26 of the extension 24. The tensioner 28 automatically moves the extension 24 to the upright, vertical position when the chair 100 and the lifting apparatus 10 are not in use.

Figure 5:
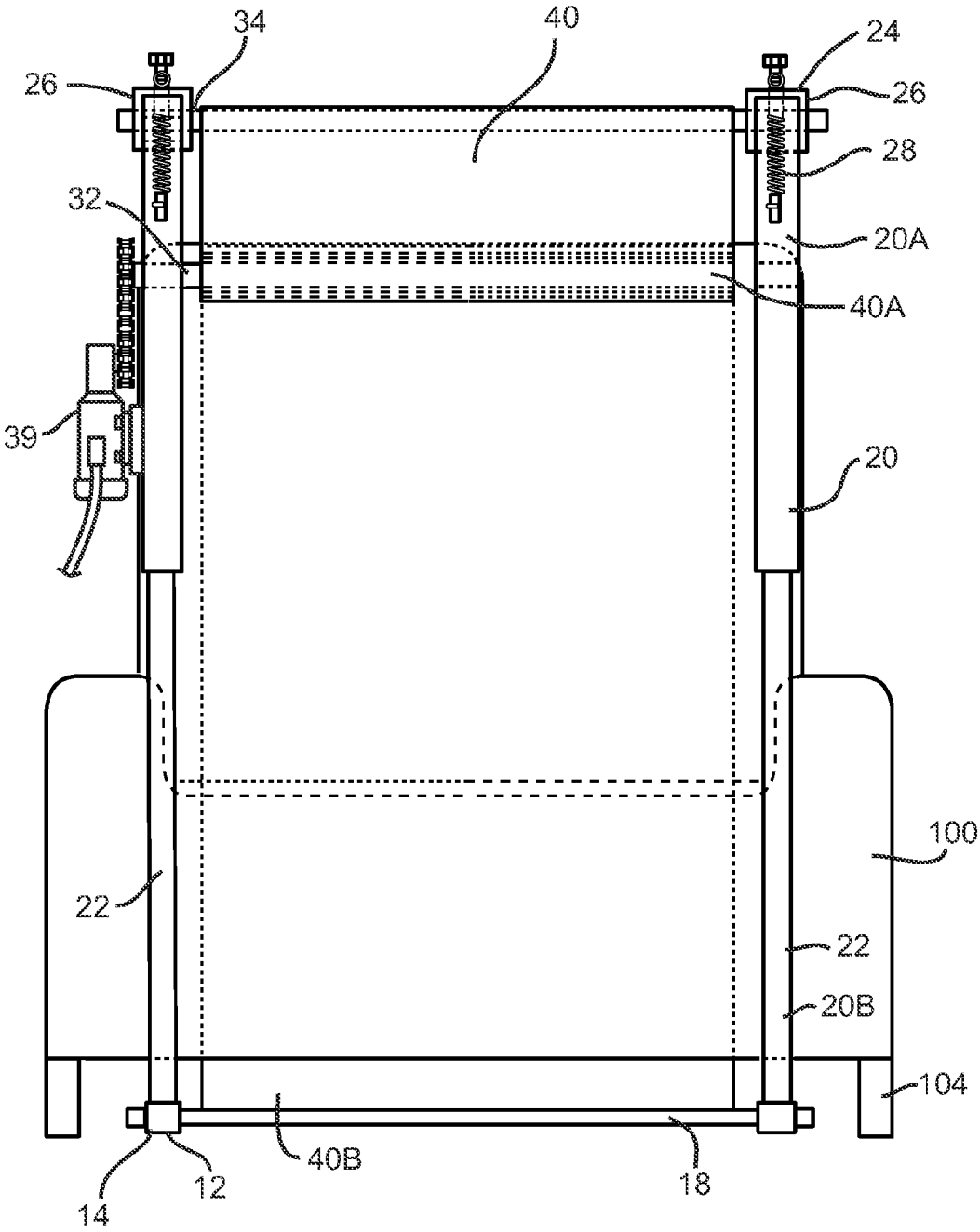
FIG. 5 is a back view of the lifting apparatus 10 in position around a chair 100 showing an electric motor 39 connected to the main roller 32.

In one (1) embodiment, the main roller 32 is the only roller connected to the activation mechanism. In one (1) embodiment, the activation mechanism is a manual crank 38. The manual crank 38 can be directly connected to the main roller 32 to rotate the main roller 32, or the manual crank 38 can be indirectly connected to the main roller 32 such as through the use of a chain drive or a belt drive. In another embodiment, the activation mechanism is a motor 39. In one (1) embodiment, the manual crank 38 is replaced by an electric motor 39 (FIG. 5). It is understood that the crank 38 or motor 39 can be positioned at a variety of locations on or adjacent to the lifting apparatus 10. It is understood that the activation mechanism can be any means well known in the art for rotating a shaft. In one (1) embodiment, the rollers 32, 34 and 36 have a ratchet to assist in tightening the lifting surface 40 and holding the lifting surface 40 taut.

The lifting surface 40 has a first end 40A and a second end 40B with sides extending between the ends. The lifting surface 40 extends between the tightening mechanism and the base 12. In one (1) embodiment, the first end 40A of the lifting surface 40 is permanently mounted to the main roller 32 of the tightening mechanism. In one (1) embodiment, the second end 40B of the lifting surface 40 is removably secured to the front bar 16 of the base 12. In one (1) embodiment, the lifting surface 40 extends from the main roller 32 over the second and third idle rollers 34 and 36 of the tightening mechanism to the front bar 16 of the base 12. In one (1) embodiment, the lifting surface 40 is constructed of a pliable material. In one (1) embodiment, the lifting surface 40 does not stretch or expand under normal use. In one (1) embodiment, the lifting surface 40 is constructed of canvas. It is understood that the lifting surface 40 can be constructed of any lightweight, durable and flexible material that is capable of following the lines of the chair 100 when in the relaxed position and capable of lifting a user from the sitting position in the chair 100 to a semi-upright position when in use. The lifting surface 40 has a width between the sides such as to provide full support for the user. It is understood that the width of the lifting surface 40 can be varied as necessary to accommodate users of varying sizes. In one (1) embodiment, the lifting surface 40 has a width between the sides such as to essentially cover the full width of the seating surface of the chair 100. In one (1) embodiment, the lifting surface 40 is a single piece of material.

In one (1) embodiment, the lifting surface 40 is provided with a seating area 44. In one (1) embodiment, the seating area 44 is formed by cords 42 secured along each side of the lifting surface 40. The cords 42 extend between spaced apart connection points 46 and 48 along each side of the lifting surface 40 and are secured to the lifting surface 40 adjacent each connection point. The seating area 44 is formed when the lifting surface 40 is moved from the relaxed sitting position to the tightened, lifting position (FIG. 1). The length of the cords 42 is shorter than the length of the lifting surface 40 between the two (2) connection points 46 and 48 of each cord 42 such that a sag or dip in the lifting surface 40 is formed between the upper and lower connection points 46 and 48 of the cords 42 when the lifting surface 40 is tightened or moved to the lifting position. In one (1) embodiment, the seating area 44 is formed by reinforcing a portion of the lifting surface 40. In one (1) embodiment, the seating area 44 has a thickness greater than the other portions of the lifting surface 40. In one (1) embodiment, the seating area 44 has a width between the sides greater than the width of the other portions of the lifting surface 40. In one (1) embodiment, the sides of the lifting surface 40 adjacent the seating area 44 are reinforced. In one (1) embodiment, the seating area 44 is permanently formed in the lifting surface 40. In one (1) embodiment, the seating area 44 is formed by a semi-rigid piece that is attached to the lifting surface 40 or is integrated into the lifting surface 40. In one (1) embodiment, the seating piece is constructed of foam. In one (1) embodiment, the seating area 44 is soft or semi-pliant but holds a set shape. In one (1) embodiment, the seating area structure or piece is mounted adjacent an underneath side of the lifting surface 40. The seating area 44 is of as a size as to accommodate the backside of a user. The seating area 44 reduces slipping of the user along the lifting surface 40 when the lifting surface 40 is moved from the relaxed, seating position to the taut, lifting position. The seating area 44 assists in correctly positioning the lifting surface 40 on the chair 100 by indicating which portion of the lifting surface 40 should be on the seat portion of the chair 100. The seating area 44 also assists in correctly positioning the user on the lifting surface 40.

The lifting apparatus 10 is intended to be portable such as to be able to be used with a variety of different sizes and types of chairs, couches and other seating surfaces. The lifting apparatus 10 helps users who have difficulty lifting themselves out of a chair 100 to move from a sitting position to a standing position. In one (1) embodiment, the lifting apparatus 10 is intended to provide assistance to a user to move a user from a sitting position to a standing position.

To use the lifting apparatus 10, the lifting apparatus 10 is moved out of the folded position into the use position such that the back frame 20 is essentially perpendicular to the base 12. Next, the base 12 is slid under the chair 100 from the back such that the first ends 14A of the beams 14 of the base 12 are adjacent the front legs 102 of the chair 100 and the back frame 20 extends upward adjacent the back portion 106 of the chair 100. In one (1) embodiment, the front bar 16 is positioned adjacent the front legs 102 of the chair 100 on a side opposite the back legs 104 of the chair 100. Once in position, if a lock is provided, the base 12 and the back frame 20 are locked in position. Next, the front bar 16 of the base 12 is connected to the first ends 14A of the beams 14 of the base 12. In one (1) embodiment, the second end 40B of the lifting surface 40 is permanently secured to the front bar 16. In this embodiment, when the lifting apparatus 10 is stored, the front bar 16 is removed from the base 12 and stored adjacent the tightening mechanism or adjacent the back frame 20, so that, in use, when the front bar 16 is moved toward the front of the chair 100 and secured to the base 12, the lifting surface 40 extends from the main roller 32 over the idle rollers, 34 and 36 on the extension 24 along the front surface 108 of the chair 100 to the front bar 16. In another embodiment, the second end 40B of the lifting surface 40 is removably secured to the front bar 16, and the front bar 16 is permanently or removably secured to the base 12 so that once the base 12 is in position under the chair 100, the second end 40B of the lifting surface 40 is moved from the main roller 32 of the tightening mechanism at the first end 20A of the back frame 20 over the idle rollers 34 and 36 on the extension 24 and over the front surface 108 of the chair 100 and secured to the front bar 16 of the base 12.

Figure 4:
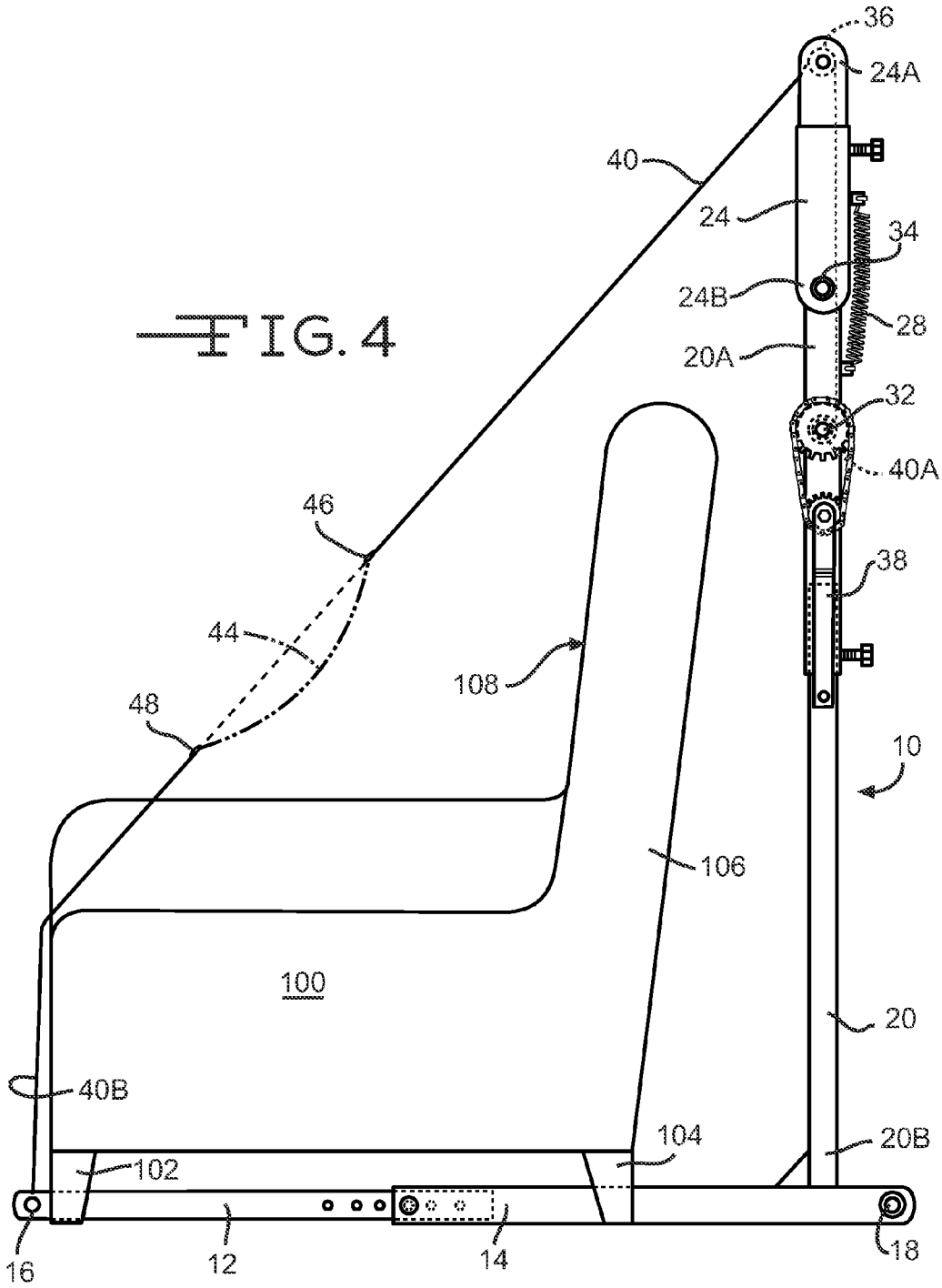
FIG. 4 is a side view of the lifting apparatus 10 in position around a chair 100 with the extension 24 in the upright, vertical position.

The user sits in the chair 100 when the lifting surface 40 is in the at rest, relaxed position. In the at rest, relaxed position, the lifting surface 40 follows the front surface 108 of the chair 100 and is in contact with the front surface 108 of the seat portion and the front surface 108 of the back portion 106 of the chair 100. In one (1) embodiment, when the lifting apparatus 10 is in the at rest, relaxed position, the extension 24 is in the upright, vertical at rest position which moves the lifting surface 40 away from the chair 100 (FIG. 4). In this embodiment, when the user sits in the chair 100, the lifting surface 40 is moved toward the front surface 108 of the chair 100 and the lifting surface 40 exerts a downward force on the extension so that the extension 24 pivots to the lifting position, essentially perpendicular to the back frame 20. The extension 24 is pivoted toward a front of the chair 100. In the fully pivoted, use position, the first end 24A of the extension 24 extends beyond the back portion 106 of the chair 100 toward the front of the chair 100. The position of the first end 24A of the extension 24 and the third, idle roller 36 in front of the back portion 106 of the chair 100 allows the lifting surface 40 to be pulled essentially upward at a point closer to the back of the user and the seat of the chair 100 which allows for essentially an upward pull or upward force to be applied by the lifting surface 40 on the user to lift the user. When a user wants to rise out of the chair 100, the tightening mechanism is activated. In one (1) embodiment, when the tightening mechanism is activated, the main roller 32 is rotated which winds or rolls the lifting surface 40 around the main roller 32 which shortens the exposed length of the lifting surface 40 extending over the chair 100. As the lifting surface 40 is shortened or tightened, the lifting surface 40 moves away from the chair 100 which lifts the user away from the chair 100. In one (1) embodiment having the seating area 44 formed during lifting, as the lifting surface 40 is pulled taut, the cords 42 along the sides of the lifting surface 40 form the seating area 44 in the lifting surface 40 which tends to cup the backside of the user and prevents the user from sliding down the lifting surface 40 as the lifting surface 40 is tightened. In another embodiment, where the seating area 44 is permanently formed in the lifting surface 40, the formed seating area 44 cups the backside of the user throughout the lifting process and prevents the user from sliding on the lifting surface 40. In one (1) embodiment, the user is lifted by the lifting apparatus 10 out of the chair 100 to a semi-upright position. Once the user is in the semi-upright position, the user can exit the chair 100. Once the user exits the chair 100, the tension on the lifting surface 40 is released and the downward force applied by the lifting surface 40 on the extension 24 is removed so that the tensioner 28 moves the extension 24 into the upright, vertical, at rest position, In the foregoing description, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated by reference herein in their entirety, with each claim standing on its own as a separate embodiment of the present invention.

It is intended that the foregoing description be only illustrative of the present invention and that the present invention be limited only by the hereinafter appended claims.

I claim:

1. A lifting apparatus for use with a chair, which comprises:

a) a base;

b) a back frame connected to the base;

c) an extension mounted on the back frame;

d) a first roller rotatably mounted on the back frame;

e) a second roller rotatably mounted on the extension;

f) a lifting surface connected between the first roller and the base;

g) a seating area formed in the lifting surface; and h) an activation mechanism connected to the first roller for rotating the first roller to move the lifting surface onto the first roller and away from a front surface of the chair.

2. The lifting apparatus of claim 1 wherein the activation mechanism is a motor.

3. The lifting apparatus of claim 1 wherein the base is mounted essentially perpendicular to the back frame.

4. The lifting apparatus of claim 1 wherein the lifting surface is constructed of pliable material.

5. The lifting apparatus of claim 1 wherein the lifting surface has opposed ends with sides extending between the ends, wherein cords having opposed ends are mounted at each end to connection points along each side of the lifting surface adjacent the seating area such that the cords extend between the connection points along the sides of the lifting surface and wherein the cords have a length between the ends less than a length of the lifting surface between the connection points.

6. The lifting apparatus of claim 1 wherein the back frame has opposed first and second ends and the base is mounted to the second end of the back frame and the extension is mounted on the first end of the back frame.

7. The lifting apparatus of claim 6 wherein the extension has opposed first and second ends with the second end mounted on the back frame and wherein the second roller is mounted adjacent the second end of the extension.

8. The lifting apparatus of claim 7 wherein a third roller is rotatably mounted on the extension adjacent the first end of the extension.

9. The lifting apparatus of claim 8 wherein the second and third rollers rotate freely in the extension.

10. A lifting apparatus for use with a chair, which comprises:

a) a base;

b) a back frame connected to the base;

c) an extension pivotably mounted on the back frame;

d) a first roller rotatably mounted on the back frame;

e) a second roller rotatably mounted on the extension;

f) a lifting surface connected between the first roller and the base; and g) an activation mechanism connected to the first roller for rotating the first roller to move the lifting surface onto the first roller and away from a front surface of the chair.

11. The lifting apparatus of claim 10 wherein in an unpivoted, at rest position, the extension is essentially aligned with the back frame.

12. The lifting apparatus of claim 10 wherein a tensioner extends between the extension and the back frame and moves the extension into an at rest, unpivoted position when the lifting apparatus is not is use.

13. The lifting apparatus of claim 10 wherein in a pivoted, in use position, the extension is essentially perpendicular to the back frame.

14. The lifting apparatus of claim 13 wherein in the pivoted, in use position, the extension is essentially parallel to the base and the extension and base extend outward from the back frame in a same direction.

15. A lifting apparatus for use with a chair, which comprises:

a) a back frame having opposed first and second ends;

b) a base having opposed first and second ends with the second end of the base mounted on the second end of the back frame;

c) an extension mounted on the first end of the back frame;

d) a first roller rotatably mounted on the back frame;

e) a second roller rotatably mounted on the extension;

f) a lifting surface having opposed first and second ends and extending from the first roller over the second roller to the first end of the base with the first end of the lifting surface mounted on the first roller; and an activation mechanism connected to the first roller for rotating the first roller to move the lifting surface onto the first roller and away from a front surface of the chair.

16. A lifting apparatus for use with a chair which comprises:

a) a base having a first end and a second end;

b) a back frame having a first end and a second end and mounted on the second end to the second end of the base;

c) an extension having a first end and second end and mounted on the second end to the first end of the back frame;

d) a first roller rotatably mounted between the first and second ends of the back frame;

e) a second roller rotatably mounted adjacent the first end of the back frame;

f) an activation mechanism connected to the first roller for rotating the first roller; and g) a lifting surface having opposed first and second ends and connected at the first end to the first roller and connected at the second end to the base, wherein the lifting surface is configured to extend adjacent a front surface of the chair.

17. The lifting apparatus of claim 16 wherein a third roller is mounted adjacent the first end of the extension.

18. The lifting apparatus of claim 16 wherein the base is mounted essentially perpendicular to the back frame.

19. The lifting apparatus of claim 16 wherein the lifting surface is constructed of pliable material.

20. The lifting apparatus of claim 16 wherein the extension is pivotably mounted on the back frame.

21. The lifting apparatus of claim 20 wherein in a pivoted, use position, the extension is essentially perpendicular to the back frame and essentially parallel to the base and the extension and base extend outward from the back frame in a same direction.

22. The lifting apparatus of claim 20 wherein in an unpivoted, at rest position, the extension is essentially aligned with the back frame.

23. The lifting apparatus of claim 22 wherein a tensioner extends between the extension and the back frame and moves the extension into the at rest, unpivoted position when the lifting apparatus is not is use.

24. The lifting apparatus of claim 16 wherein a seating area is formed in the lifting surface between the ends of the lifting surface.

25. The lifting apparatus of claim 24 wherein the lifting surface has opposed ends with sides extending between the ends, wherein cords having opposed ends are mounted at each end to connection points along each side of the lifting surface adjacent the seating area such that the cords extend between the connection points along the sides of the lifting surface and wherein the cords have a length between the ends less than a length of the lifting surface between the connection points.

26. A method of lifting a user from a chair, which comprises the steps of:

a) providing a lifting apparatus having a base, a back frame connected to the base, an extension mounted on the back frame, a first roller rotatably mounted on the back frame; a second roller rotatably mounted on the extension, a lifting surface having first and second ends and connected between the first roller and the base, and an activation mechanism connected to the first roller;

b) positioning the lifting apparatus so that the base of the lifting apparatus extends adjacent and below a seat of the chair and the back frame extends upward adjacent a back portion of the chair;

c) connecting the first end of the lifting surface to the first roller and the second end of the lifting surface to the base so that the lifting surface extends over the chair adjacent a front surface of the chair;

d) sitting the user in the chair so that the lifting surface is positioned between the user and the front surface of the chair; and e) activating the activation mechanism so that the first roller rotates and wraps the lifting surface around the first roller and a length of the lifting surface adjacent the front surface of the chair is reduced so that the lifting surface is moved way from the front surface of the chair and so that the user in the chair on the lifting surface is moved away from the front surface of the chair to a semi-upright position.

27. The method of claim 26 wherein the extension has opposed first and second ends and is pivotably mounted at the second end on the back frame opposite the base and further in step d), when the user sits in the chair and contacts the lifting surface, the lifting surface exerts a downward force on the extension which pivots the extension into a pivoted, essentially horizontal, in use position.

28. The method of claim 27 wherein a third roller is mounted on the first end of the extension and the second roller is mounted on the second end of the extension and wherein further in step e), the lifting surface moves over and contacts the second and third rollers as the lifting surface is wrapped around the first roller and the length of the lifting surface is reduced.

29. The method of claim 27 wherein further in step b), the lifting apparatus is positioned so that when the extension is moved to the pivoted, essentially horizontal, in use position, the first end of the extension extends beyond the back portion of the chair toward the front of the chair.

30. The method of claim 27 wherein a tensioner is provided between the extension and the back frame and wherein after step e), when the user is no longer applying a force on the lifting surface, the tensioner moves the extension to an at rest, essentially vertical position.

* * * * *